United States Patent [19]

Lynch

[11] Patent Number: 4,680,016

[45] Date of Patent: Jul. 14, 1987

[54] APPARATUS AND METHOD FOR RIMMING CONTAINERS

[76] Inventor: Bobby R. Lynch, R.R. #2 Box 57, Ozark, Mo. 65721

[21] Appl. No.: 824,506

[22] Filed: Jan. 31, 1986

[51] Int. Cl.[4] ..... B31B 1/28

[52] U.S. Cl. ..... 493/159; 493/158; 425/394

[58] Field of Search ..... 493/106, 107, 109, 108, 493/152, 158, 159; 425/394

[56] References Cited

U.S. PATENT DOCUMENTS

| | | | |
|---|---|---|---|
| 2,017,018 | 10/1935 | Seastrom | 493/158 |
| 2,278,299 | 3/1942 | Barbieri | 493/158 |
| 2,778,287 | 1/1957 | Moore | 493/158 |
| 2,819,658 | 1/1958 | Scott et al. | 493/158 |
| 3,468,226 | 9/1969 | England et al. | 493/109 |

*Primary Examiner*—Frederick R. Schmidt
*Assistant Examiner*—Robert Showalter
*Attorney, Agent, or Firm*—E. J. Holler

[57] ABSTRACT

This invention relates to improved apparatus and method for forming the rim portion of frustoconically-shaped containers, preferably formed of paper or thermoplastic material. The invention is especially adapted to forming the helicoidal rim on the mouth of drinking cups as well as other types of frustoconical-shaped containers. The container sidewalls adjacent the open mouth are fully supported during rimming to provide stronger and more dimensionally accurate, uniform rims on such containers.

16 Claims, 6 Drawing Figures

APPARATUS AND METHOD FOR RIMMING CONTAINERS

BACKGROUND OF THE INVENTION

1. Field of the Invention

This invention relates to apparatus and method for rimming or curling, and more particularly to a tooled die mechanism which is employed to form the rim of open mouth containers. The present invention is particularly adapted to forming a helicoidal rim at the mouth of drinking cups and other types of frustoconically-shaped containers where the rim must be durably and uniformly fabricated.

2. Description of the Prior Art

Previously, many types of paper and thermoplastic containers have been rimmed by spinning tool crimpers and externally heated non-rotating means. Both methods essentially form a rim by pushing against the unsupported leading edge of the frustoconically-shaped container. This frequently results in collapse of the unsupported sidewall area and/or nonuniformly formed rims. In addition, the spinning tool types of crimpers introduce a torque to the unsupported leading edge of the frustoconically-shaped container. This torque plus axial force causes a twisting type of collapse to the container wall in addition to the previously described failure due to axial motion only. These aforementioned distortions or wrinkles disastrously affect the overall strength and appearance of the container.

Various types of rimming tool methods have not heretofore been capable of providing structural support to the portion of the container blank to be rimmed during the actual formulation of the rim. This lack of support to the length of the blank to be rimmed plus the lack of support adjacent the rim results in loss of production or making containers having sidewall variations or wrinkling thereat which affect the overall appearance and performance of the containers. Obviously rim strength and its uniform adjacent sidewall are important characteristics in the manufacture of relatively thin-walled cups of various sizes, whether they be fabricated of paper, thermoplastic, or other materials. When the sidewall adjacent the open edge is unsupported during rimming, it is not uncommon for the sidewall to be wrinkled or misshapened during rimming which produces containers lacking in high-quality performance and appearance.

The present invention provides an improved mandrel mechanism and method for rimming container bodies and especially paper and plastic cups which may be radially curled while maintaining the sidewalls in fully supported arrangement. The improved mandrel and stationary rimming tool mechanism of the present invention facilitate rimming paper and plastic containers at relatively high speeds in an efficient manner, such that the deleterious effects of container sidewall warping and distortion are eliminated. The present apparatus and method provide means for forming more uniform and strongly reinforced rims at the mouth of containers having generally cylindrical or tapered sidewalls, the rim being formed with a helicoidal configuration adapted to the engagement with a container closure for durable sealing. While the invention is primarily directed to radially curling containers of an essentially circular cross-sectional configuration, the apparatus permits forming either helicoidal or elongated rims with essentially uniform adjacent sidewalls from which the rims depend.

U.S. Pat. No. 2,778,287 to Moore relates to apparatus for curling containers without requiring any spinning or rotational movement. The curling die forming the curled rim is actuated longitudinally coincident with the axis of the body wall of the container; however, such apparatus is not capable of rimming conically-shaped containers with the uniformity and strength required of modern day containers when made by high speed production methods.

These and other objects of the present invention will become more fully apparent with reference to the following specification and drawings which relate to the preferred embodiment thereof for the manufacture of paper, thermoplastic, or other containers.

SUMMARY OF THE INVENTION

The present invention is applicable to rimming various types of containers, especially frustoconical-shaped cups fabricated of either uncoated or thermoplastically coated paper board as well as thermoplastic materials of both foamed and non-foamed types. The invention as described herein is most commonly applicable to rimming thermoplastic coated paperboard cups coated either on one or both sides to permit the retention of both hot and cold fluids. The improved method and mandrel apparatus are especially useful for rimming essentially two-piece cups by the application of frictional heat and pressure wherein the rim and adjacent sidewall are formed with precise dimensions and virtually no distortion or wrinkling and at speeds generally higher than allowable with present day production techniques. The rimming tool may remain unheated or in some cases be moderately heated to soften the thermoplastic coating on the paperboard sidewalls of the container so that more controllable rolling or curling of the rim can be achieved when the blanks are brought into pressurized contact with the forming apparatus.

The mandrel structure of the present invention comprises a main frustoconical supporting section having tapered sidewalls complemental to the blank sidewalls. The splined surface remains engaged at all times with the mating splines of the fixed rimming member having an annular groove which receives and primarily forms the container rim. The mandrel spline is capable of axial motion while allowing the mating frustoconically-shaped mandrel to rotate freely while being axially energized by a mechanism at the proper station. The interengaged splined surfaces serve to essentially fully support the container sidewalls adjacent the edge to be rimmed without causing any distortion of the blank thereat and permitting the rimming to proceed in a precisely controllable manner. The interior surface of the tapered container sidewall is engaged by the segmented splined surfaces for its full support as the container edge axially proceeds into an annular rimming groove of a fixed rimming tool which operates in conjunction with a tucking finger element to guide the rim portion into the precisely helicoidal structure. The combined spline surfaces of the two splined components permit the forward motion of the container sidewall into the rimming elements at precisely the taper angle of the cup sidewall so that the rimming may be achieved most expeditiously and efficiently. The closely adjacent sidewall retains its original strength and appearance characteristics without experiencing any deleterious effects from the axially and rotationally pressurized rollover of the open edge into the precisely formed rim.

DETAILED DESCRIPTION OF THE PREFERRED EMBODIMENTS

Figure 1:
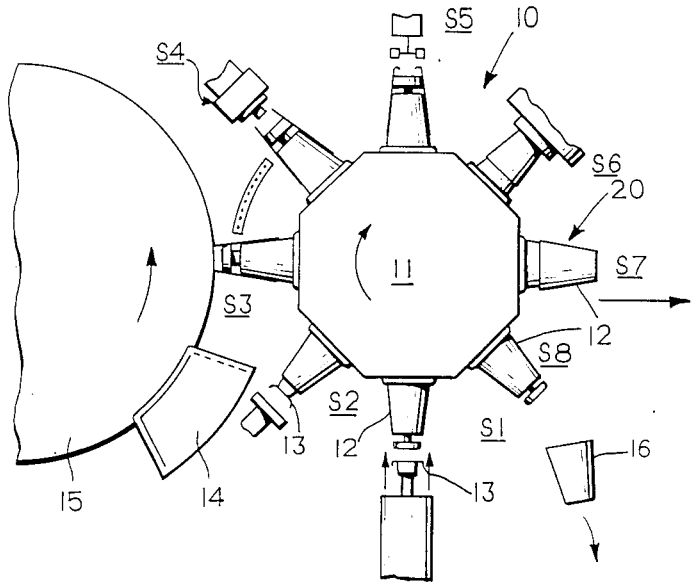
FIG. 1 is a schematic illustration of a cup making machine having a turret which carries a series of forming mandrels from work station to work station to complete the assembly and forming process.

Referring in detail to the drawings and particularly to FIG. 1, the manufacture of a two-piece frustoconical container or cup is initiated by a forming apparatus 10 illustrated as comprising a forming turret 11 with a plurality of radially-disposed forming mandrels 12 extending therefrom in a symmetrical equi-spaced array. Each of the mandrels 12 is indexed by the forming turret to peripherally disposed work stations at which individual fabricating steps are accomplished. The work stations are designated as S1 through S8 in the clockwise sequence shown in FIG. 1, commencing at the 6:00 o'clock position for the first work station S1.

Normally, at the first work station S1, a cup bottom blank 13 is formed and transferred into juxtaposition with the extended tip portion of a forming mandrel 12 where it is held by vacuum. The bottom blank is indexed to the second work station designated as S2 where the bottom blank is reformed to the desired shape for cooperating with the sidewall blank 14 which is placed in wrapped relation upon the mandrel at the third working station S3 by means of the transfer turret 15 shown in FIG. 1. Adhesive patterns are applied to the sidewall blank immediately prior to its delivery to the third work station S3 where it is wrapped about the forming mandrel and brought into engagement with the formed bottom blank on the mandrel nose piece.

As the forming turret with its multiplicity of forming mandrels indexes to the fourth work station S4, the bottom is bonded to the sidewall blank and a side seam is formed for proper bonding of the lapped sidewall. When the turret indexes from the third work station S3 to the fourth work station S4, heat is frequently applied to the side seam area during its travel from the third work station S3 to the fourth work station S4 during which the sides and bottom of the container are sealed into a durable two-piece container blank.

At the fifth work station S5, the lowermost extension of the sidewall beyond the skirt of the bottom blank is turned inwardly and the bottom forming is completed at the sixth work station S6 by mechanically pressing a pressure wheel to the bottom seal.

Figure 3:
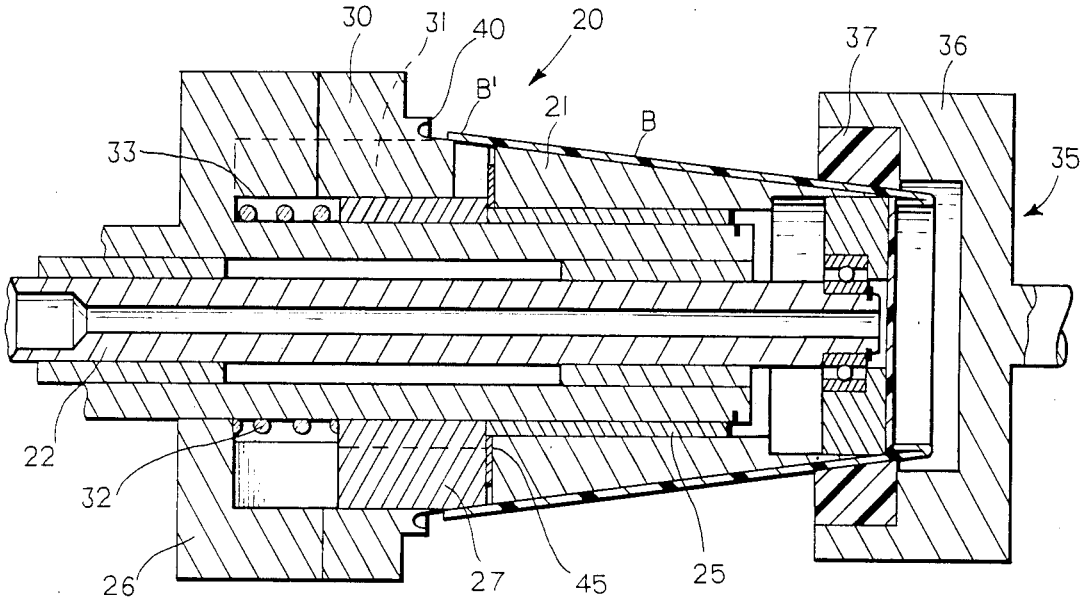
FIG. 3 is a vertical cross-sectional view of the mandrel rotating mechanism with axially movable spline with a container body shell mounted in the proper position for initial axial movement toward the fixed rimming member.

At the sixth work station S6, the turret is rotated once more to index the container to the seventh work station S7, wherein it is brought into axial alignment with a rotational mechanism 35 as shown in FIG. 3 for rotating the mandrel and container blank thereon.

At the seventh work station S7, the container is rimmed by the rimming mechanism of the present invention as more fully described hereinbelow, following which it may be ejected from the machine as a finished container 16 and delivered to suitable packaging apparatus. The particular mandrel and rim forming components of the present invention are now described in detail.

Figure 2:
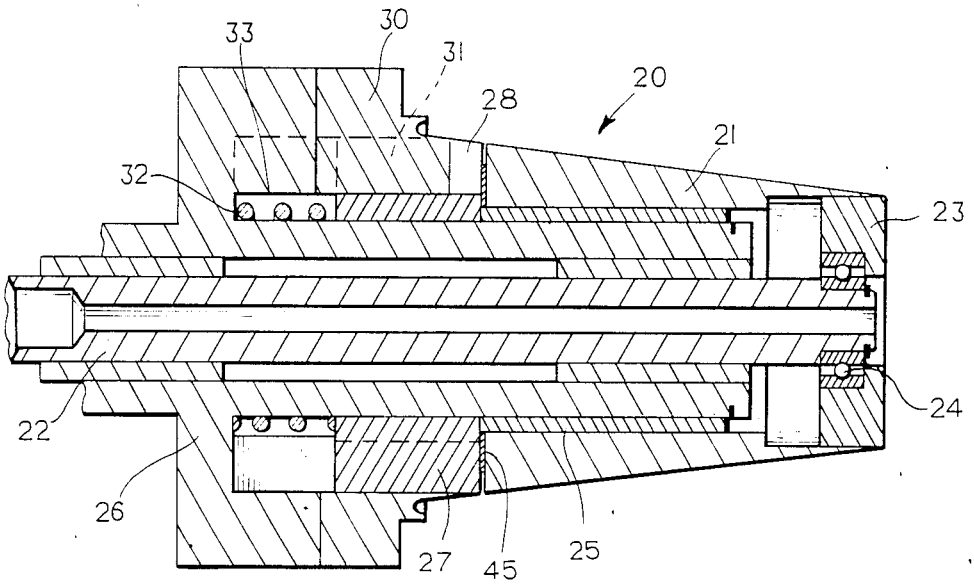
FIG. 2 is a vertical cross-sectional view of the rotary rim forming mandrel and stationary rimming tool of the present invention.

The forming mandrel 20 shown in vertical section in FIG. 2, is especially structured to facilitate the rimming operation. All of the mandrels on the turret shown in FIG. 1 are preferably so configured, not only to permit the previously described cup forming operations, but improved rimming. The body portion 21 of the mandrel has a frustoconical exterior configuration adapted to support a tapering container blank thereon as shown in FIG. 3. Mandrel body 21 is rotatably supported in cantilevered relation on a central shaft 22 by means of bearing member 25 with the snap ring retainer. Bearing member 25 is press fitted to the internal diameter of the mandrel body 21 and is free to rotate on central shaft 22. Thrust bearing 45 is positioned between the rotating member 21 and splined member 27 to allow rotation of member 21 under axial pressure against the vertical mating surface of spline 27. A cylindrical sleeve 25 is mounted between the rotatable exterior body portion 21 of the mandrel and a primary supporting member 26 having an essentially cylindrical configuration at its cantilevered area. Supporting member 26 is fixedly supported by proper fastening to the mandrel turret 11 to permit free rotation of the outer portion of the mandrel in precisely aligned relation. An annular intermediate member 27 of the mandrel having splined exterior surfaces 28 is mounted substantially interiorly of the mandrel, the splined member 27 being capable of only axial movement with respect to the major surfaces of the mandrel exterior member 21. The splined exterior surfaces 28 of splined member 27 provide a continually enlarging taper of the mandrel exterior complementally contoured to the blank taper and are capable of cooperation with a similarly splined portion of the stationary rimming member 30. The splines 31 of the rimming member are capable of mating interconnection with the splines 28 of the splined member 27 to provide full support to the container blank open mouth portion as shown in FIGS. 3 and 4.

Tubular member 25 is a sleeve-like bearing for the mandrel body portion to permit its rotation at various work stations including the rimming station. Thus, the mandrel body portion 21 may be rotated by a cup-shaped rotating member 35 at the rimming station, as shown in FIGS. 3 and 4. The rotating mechanism preferably comprises a cup-shaped element 36 having an annular elastomeric member 37 provided within the rotational member adapted to contact a lower portion of the container blank retained upon the mandrel and end cap member. Elastomeric member 37 may be formed of soft rubber or polyurethane foam to engage the blank bottom portion to effect combined rotation of mandrel body portion 21 and the blank.

A compression spring 32 is mounted within an internal recess 33 in the primary mandrel member 26. The spring is positioned contacting the bottom of the recess with the other face contacting intermediate splined member 27. When rotational mechanism 35 contacts the blank bottom for its rotation, additional axial pressure applied by such mechanism causes the intermediate splined member 27 to be forced to axially move more deeply into the mating splines 31 of fixed rimming member 30. Very little space then exists between the mated splines for essentially full sidewall support. The splines are continually engaged so that continuity of support for the underside of the leading surfaces of the body shell is maintained as these surfaces are axially moved toward the fixed rimming member 30.

Figure 4:
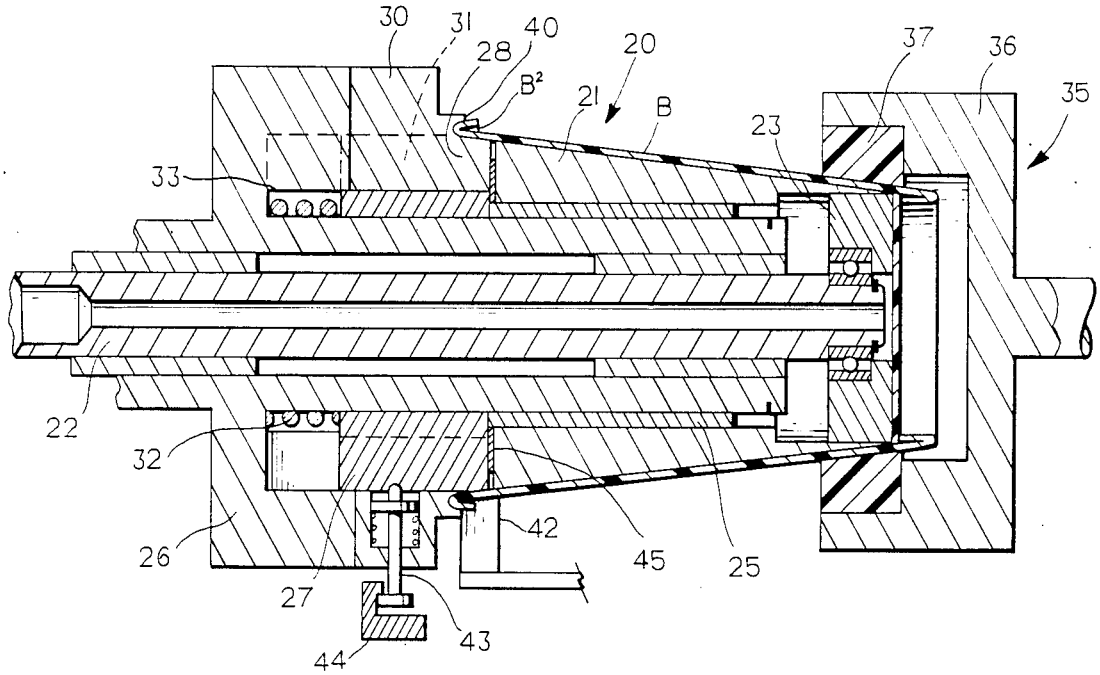
FIG. 4 is a vertical cross-sectional view similar to FIG. 3 of the container blank with its rim being formed by the combined mechanism.

Stationary rimming member 30 has a semi-circular annular groove 40 therein facing the open edge of the container blank as shown in FIGS. 3 and 4. The blank designated by the letter B in FIG. 3 is shown upon initial axial movement of the rotating member 35 with the blank bottom. Rotational member 35 is capable of providing both axial movement to the blank as well as rotational movement. Upon initial rotation of the blank and its movement from right to left as shown in FIG. 3, splined surfaces 28 and the splined surface 31 of member 30 are engaged against the spring 32 which is housed and supported by member 26. The spring 32 allows uniform resistance to the axial movement of the mandrel 21, spline 27 and blank B. The spring 32 also ejects the rimmed container from the working groove of the stationary member 30 at the proper sequence explained later. The spring 32 also serves to hold the splined surfaces 28 of member 27 in proper position and angular alignment with the mating splined surfaces of member 30 to thereby support the container open-mouth portion designated by the numeral $B^1$. As the blank is moved so that its open edge is contacted by the annular groove 40, the sidewall portion adjacent the open edge is fully supported by the splined surfaces having closely mating contours. As the blank is moved further into contact with the annular groove 40 the rim portion $B^2$ initially assumes a semi-circular contour and is further formed into a helicoidal shape by a tucking finger 42 which is mounted at the rimming station and timed to move into contact with the blank open edge as the annular groove 40 initially begins the rimming operation. A spring detent 43, as shown in FIG. 4, is mounted within a lower region of primary supporting member 30, the detent moving into splined intermediate member 27 to temporarily retain the splines in combined relation until the rimming operation is completed. After the rim is fully formed, the mandrel moves toward station S8, allowing the detent to be released by cam 44. This breaks the finished container from the annular rimming groove 40 and prepares the container for ejection at station S8. This also allows splined intermediate member 27 to again move into its extended position closely adjacent body member 21.

Members 22, 23, and 24 effect the proper positioning of the bottom 13 at the proper forming station on the mandrel turret 11. The hollow stem of member 22 allows vacuum application to hold the bottom 13 in place as the turret rotates. Also, this allows the application of a small jet of pressurized air to eject the finished container at station S8.

Figure 5:
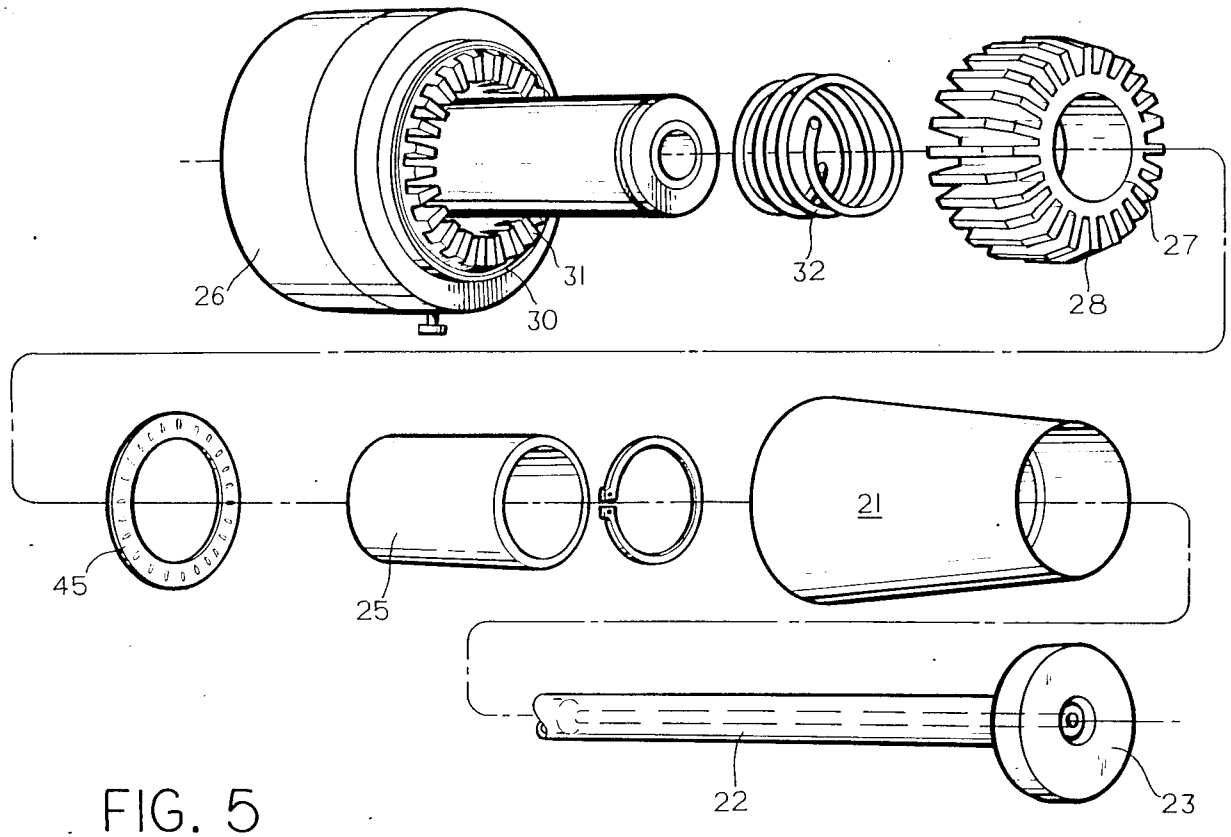
FIG. 5 is an exploded perspective view of the component parts of the rimming mandrel.
Figure 6:
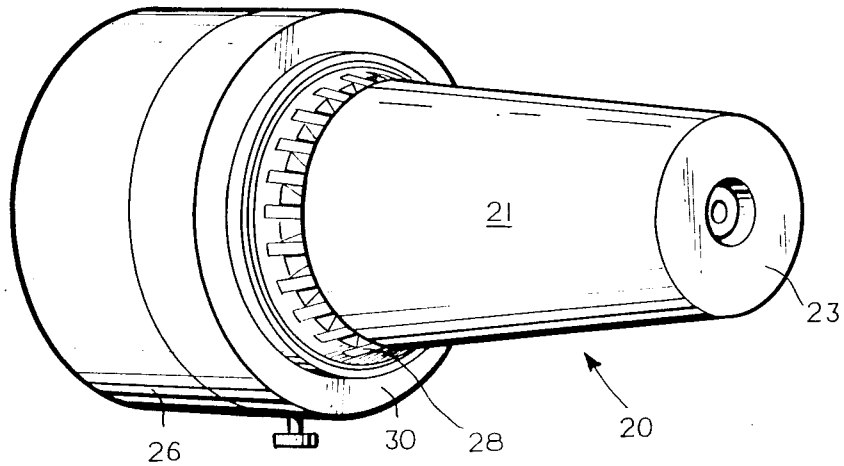
FIG. 6 is a perspective view of the assembled mandrel.

FIG. 5 shows in an exploded view the component parts of the improved mandrel and rimming member having the plurality of splines to facilitate full support of the container sidewall closely adjacent the open edge to be rimmed. The splines have tapered surfaces at their extremities to facilitate continued engagement and support continuity of the body segment to be rimmed at the rimming station. The subject mandrel and rimming tool can be used on a single-station machine where only rimming is performed, or on a multiple-station machine as shown in FIG. 1 where the entire cup or container is formed. The stationary rimming tool and particularly its annular groove area 40 may be moderately heated to assist in the rimming by slightly softening thermoplastic coatings or materials. However, most processes will not require external heat since generally adequate heat is attained by the frictional contact of the open mouth area of the rotating container as it travels axially and contacts the non-rotating splines 28 of member 27, the splines 31 of member 30 and the annular groove 40 in member 30. These surfaces allow a quick buildup of frictionally generated heat which is adequately retained by these various members.

Containers such as cups, tubs, or small dish-type vessels may be fabricated and rimmed from coated or uncoated paperboard or thermoplastic material such as foamed or unfoamed polystyrene having a thickness ranging from about 5 to about 9 mils. Containers made in accordance with the present invention have shown superior sidewalls without any stressed or distorted areas adjacent the rims. Rim strength is very dependent upon the sidewall area from which it is formed. Uniformity and dimensional preciseness at such area is a requisite for interconnection of mating closures whether of the rim enveloping or plug type.

For example, the stationary members such as 26 and 30 could be so designed to rotate while allowing axial movement only of the mandrel 21. Also, the tucking finger could be easily replaced by a mating annular grooved member which totally encapsulated the rim as it was being formed.

Various modifications may be resorted to within the spirit and scope of the appended claims.

What is claimed and desired to be secured by Letters Patent is:

1. Apparatus for rimming the open mouth portion of a frustoconically-shaped container blank which includes a rimming die comprising a truncated hollow mandrel member having sloping sides complemental to the tapering sidewalls of the container blank, said mandrel member being mounted on a central shaft for its controlled rotation and axial movement, means for rotating and axially moving said mandrel member with said container blank rotatably mounted thereon, a blank support member within said mandrel, said member mounted for axial movement with said mandrel member and nonrotatively with respect to said central shaft and said mandrel member, and having a radially splined exterior surface complemental to the tapering angle of said container blank sidewalls, a stationary rimming tool member having an annular semi-circular groove adapted to receiving and shaping the open edge of the open mouth portion of said container blank during rimming and a radially splined exterior surface closely adjacent to said annular groove interengagable with said radially splined surface of said blank support member during said axial movement, said combined radially splined exterior surfaces of said blank support member and said rimming tool member being adapted to fully supporting the container open mouth portion during rimming of the open edge.

2. The apparatus in accordance with claim 1, including means for axially moving said mandrel member and said blank support member combinedly into engagement with the said splined surfaces of said rimming tool member immediately prior to rimming of the container blank open mouth portion.

3. The apparatus in accordance with claim 1, including a cup-shaped rotational member adapted to frictionally engage the bottom portion of said container blank for its rotation with said mandrel and to effect telescopic engagement of the splined blank support member with said stationary splined rimming tool member during the rimming operation.

4. The apparatus in accordance with claim 1, wherein said splined surfaces are tapered on their radial surfaces to facilitate rapid engagement and disengagement of their mating blank supporting surfaces.

5. The apparatus in accordance with claim 1, including a supplemental curved tucking finger mounted adjacent the annular groove of said rimming tool member to assist in forming the helicoidal rim of said container.

6. The apparatus in accordance with claim 1, wherein said splined surfaces include a substantial number of equispaced radial splines to provide tapered mating surfaces for essentially full support of the blank sidewalls closely adjacent its open mouth portion during rimming of said container blank.

7. The apparatus in accordance with claim 1, wherein said splined exterior surfaces are radially equispaced and adapted to be axially interengagable to provide an essentially continuous segmented tapered surface for interiorly supporting the container blank sidewalls closely adjacent the open edge fo said open mouth portion during rimming.

8. The apparatus in accordance with claim 1, wherein the said splined surfaces of said stationary rimming tool member are radial and disposed closely adjacent the said annular groove for supporting an adjacent sidewall portion while shaping the container blank open edge portion during rimming.

9. The apparatus in accordance with claim 1, wherein said annular groove has a semi-circular configuration adapted to receive the open edge of the container open mouth portion during rimming into a helicoidal rim structure.

10. The method of rimming the open mouth portion of a frustoconically-shaped container blank, including the steps of mounting the said container blank on a truncated hollow rotational mandrel member having sloping sides complemental to the tapering sidewalls of the container blank and a nonrotatable blank support member mounted within said mandrel, rotating said mandrel member with said container blank mounted thereon, moving said mandrel, blank support member and blank toward a stationary rimming tool member having an annular groove adapted to receive and shape the open edge of the container open mouth portion, said blank support member and said stationary rimming tool member having complemental radially splined exterior surfaces adapted to telescopic interengagement, and supporting the container sidewalls closely adjacent said open edge by said interengaged splined surfaces during the rimming operation.

11. The method in accordance with claim 10, including the step of interengaging the said splined surfaces to support the adjacent container open mouth portion during its rotation immediately prior to rimming the open edge of said container blank with said stationary rimming tool member.

12. The method in accordance with claim 10, including the step of shaping the open edge of said container open mouth portion with a pivotally-mounted tucking finger element adapted to cooperate with said annular groove to form a helicoidal rim during container rotation.

13. The method in accordance with claim 10, including the step of moving the said radially splined surfaces telescopically together into spring biased stationary relation and rotating the said container blank and mandrel member by a cup-shaped rotational member adapted to frictionally engage the bottom portion of said container blank on said mandrel member to effect their combined rotation.

14. The method in accordance with claim 10, including the step of forming a helicoidal rim on the open mouth portion of said container blank by the combined axial movement of said container blank on said mandrel, the said blank contacting the annular groove of said rimming tool member and a pivotally-mounted tucking finger element disposed adjacent said annular groove.

15. The method in accordance with claim 10, wherein the said container blank is comprised of paper.

16. The method in accordance with claim 10, wherein the container blank has a thickness ranging from about 5 to about 9 mils.

* * * * *